US006237545B1

(12) United States Patent
Barnett et al.

(10) Patent No.: US 6,237,545 B1
(45) Date of Patent: May 29, 2001

(54) REFINERY PROCESS FURNACE

(75) Inventors: Daniel Barnett, Houston; Gregory Cargle, Cypress, both of TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/544,741

(22) Filed: Apr. 7, 2000

(51) Int. Cl.[7] ..... F22B 15/00
(52) U.S. Cl. ..... 122/235.23; 122/247; 122/511
(58) Field of Search ..... 122/235.23, 235.33, 122/246, 247, 248, 249, 250 S, 511

(56) References Cited

U.S. PATENT DOCUMENTS

| | | | | |
|---|---|---|---|---|
| 4,387,669 | * | 6/1983 | Brown | 122/235.23 |
| 4,522,157 | * | 6/1985 | O'Sullivan et al. | 122/510 |
| 4,553,502 | * | 11/1985 | Dreuilhe et al. | 122/235.23 |
| 4,658,762 | * | 4/1987 | Kendall | 122/250 R |
| 4,986,222 | * | 1/1991 | Pickell et al. | 122/250 R |
| 5,394,837 | * | 3/1995 | Tsai et al. | 122/235.23 |

* cited by examiner

*Primary Examiner*—Gregory Wilson

(74) *Attorney, Agent, or Firm*—Kellogg Brown & Root, INC

(57) ABSTRACT

Refinery process furnaces are disclosed that have horizontal-helical radiant coils and/or improved ladder-type supports for the horizontal tubes. The coils have a tubeside fluid flow path from an inlet pipe section through an alternating series of straight horizontal pipe sections and wide sweep return bends to an outlet pipe section. The horizontal pipe sections are arranged in at least two vertical banks that are parallel and horizontally spaced apart. The bent pipe sweep return bends are arranged in vertical banks at either end of the straight pipe banks. Each bend connects a pair of straight pipe sections in adjacent vertical banks, and each return bend is sloped between horizontal and vertical so that one of the straight pipe sections in the connected pair thereof is elevated with respect to the other. The ladder supports have two opposing columns with a number of vertically spaced support members each having a generally horizontal upper engagement surface. The horizontal tubes in the furnace are supported on cradles formed in transverse crosspieces that have opposite ends engaged by the support members, each end of the crosspiece having a generally horizontal lower engagement surface supported on the upper engagement surface, which allows for horizontal, upward or angled movement of the transverse crosspiece with respect to the support members that can occur due to thermal expansion thereof or shifting of the vertical columns with respect to each other.

25 Claims, 12 Drawing Sheets

REFINERY PROCESS FURNACE

FIELD OF THE INVENTION

The present invention relates to refinery process furnaces, and more particularly to furnace improvements relating to the radiant coil and to the tube supports for horizontal sections of the coil.

BACKGROUND OF THE INVENTION

Refinery process furnaces are widely used to heat hydrocarbons in a variety of services, for example, crude oil feed to an atmospheric tower, crude residuum from the atmospheric tower for feed to a vacuum tower, and the like. Perhaps the most severe service is the heating of feedstock to a delayed coker. While coke deposition can be a problem in any refinery process furnace, because of the high temperatures employed and the residual nature of the coker feedstock, there is a pronounced tendency for the formation of coke deposits on the inside wall of the radiant tubing through the coker preheat furnace.

Regardless of service, the formation of coke deposits is not desirable. Coke deposits can lead to increased pressure in the tubes due to the restriction of flow, and to higher tube wall temperatures due to the insulative effects of the coke deposits. Both higher pressure and higher temperature lead to premature failure of the tubes. Furthermore, it is often necessary to periodically remove the tube from service and remove the coke deposits by burning off the deposited coke by oxidation with air or another oxidant that is passed through the tube at a high temperature. This periodic burn-off can result in severe thermal cycling which also reduces the life of the tube.

One factor that has been identified as contributing to high coke formation rates and high tube metal temperatures is the presence of heat flux imbalances. See Martin, G. R., "Heat-Flux Imbalances in Fired Heaters Cause Operating Problems," *Hydrocarbon Processing,* pp. 103–109 (May 1998). Heat-flux imbalances can be caused by many factors, such as, for example, furnace design and furnace operating conditions, including such things as the ratio of radiant section height to width, burner-to-tube distances, number and type of burners, flame shape, air preheat and air temperature, radiant section tube layout, one or more burners out of service, insufficient air to burners, fuel gas composition, burner fuel pressure, higher-than-normal firing rates, fouled burner tips, eroded burner tip orifices, insufficient draft, and the like.

In multi-pass heating arrangements, the tube layouts in existing heaters are generally different for each pass, i.e. each pass is positioned in a different place in the furnace. A pass located at the bottom of the furnace will see a flame temperature of 3000–3500° F. (1650–1930° C.) near its outlet, but a pass located near the arch at the top of the radiant section will see much lower temperatures. One way to compensate for heat-flux imbalances is to control the relative rates of feedstock supplied to each pass so that the outlet temperatures are about the same. However, this still does not avoid the existence of hot spots in individual tube passes that can lead to localized coke deposition.

An improvement over wall-mounted tube runs in the radiant section is the double-fired heater in U.S. Pat. No. 5,078,857 to Melton. This uses a bank of tubes running centrally through the firebox with a row of burners on either side thereof. The tubes pass through slots in the end wall of the radiant section, and an insulated header cover encloses the conventional returns. Unfortunately, this tube design still does not allow the placement of multiple passes within a single firebox that have the same heating pattern and fluxes in each pass.

It would be desirable to have available a multi-pass furnace design which allows the various passes to have about the same heating pattern and heat fluxes. It would also be desirable to increase the effective tube-heating surface of each pass, while at the same time reducing the pressure drop through the tubing. Further, it would also be desirable to eliminate the need for insulated end-tube header boxes and provide an improved manner of supporting the horizontal tubes. The present invention addresses these and other needs in the refinery process furnace art.

SUMMARY OF THE INVENTION

The present invention provides a radiant coil for a refinery process furnace. The coil has an inlet pipe section and an outlet pipe section. A plurality of essentially straight horizontal pipe sections are arranged in at least two vertical banks. The vertical banks are parallel and horizontally spaced apart. A plurality of bent pipe sweep return bends are arranged in vertical banks at either end of the straight pipe banks. Each bend connects a pair of straight pipe sections in adjacent vertical banks thereof. The return bends are sloped between horizontal and vertical, and one of the straight pipe sections in the pair connected by a return bend is elevated with respect to the other. A tubeside fluid flow path is provided from the inlet pipe section through an alternating series of the straight pipe sections and the return bends to the outlet pipe section. The coil preferably includes first and second vertical straight pipe banks and opposing return bend banks, wherein the straight pipe sections and the return bends are evenly spaced from adjacent sections and bends above and below except for uppermost and lowermost pipe sections and return bends. The return bends at either end of the adjacent tube banks can be oppositely sloped so as to provide a generally horizontal-helical flow pattern. The coil preferably has first and second nested passes wherein the fluid flow paths of the first and second passes each comprise a series of alternating straight pipe sections in each of said vertical banks thereof, wherein the straight pipe sections of the first pass in the first and second banks are horizontally spaced opposite the straight pipe sections of the second pass in the respective second and first banks. The first and second pass straight pipe sections in each vertical tube bank can be alternated every other one from top to bottom.

In an alternate embodiment, the coil also has nested third and fourth passes wherein the fluid flow paths of the third and fourth passes each comprise a series of alternating straight pipe sections in each of said vertical banks thereof wherein the straight pipe sections of the third pass in the first and second banks are horizontally spaced opposite the straight pipe sections of the fourth pass in the respective second and first banks. The first, second, third and fourth pass straight pipe sections in each vertical tube bank can be alternated every fourth one from top to bottom.

In a further alternate embodiment, the coil can also have nested fifth and sixth passes wherein the fluid flow paths of the fifth and sixth passes each comprise a series of alternating straight pipe sections in each of said vertical banks thereof wherein the straight pipe sections of the fifth pass in the first and second banks are horizontally spaced opposite the straight pipe sections of the sixth pass in the respective second and first banks. The first, second, third, fourth, fifth and sixth pass straight pipe sections in each vertical tube bank can be alternated every sixth one from top to bottom.

In another aspect, the present invention provides a refinery process furnace having a firebox, a coil and floor-mounted burners. The firebox has a floor, opposing vertical sidewalls, and opposing vertical end walls. The coil described above is disposed with the straight pipe banks and the return bend banks within the firebox. Endmost vertical straight pipe banks are evenly spaced from and generally parallel to the vertical side walls, each of the return bend banks are evenly spaced from the end walls, and the inlet and outlet sections are disposed for introducing a relatively cold fluid into the flow paths and discharging a heated fluid therefrom, respectively. Multiple rows of the floor-mounted burners are arranged alternately, and evenly spaced in plan with respect to the vertical straight pipe banks. The refinery process furnace preferably comprises a plurality of the coils arranged in a vertical stack with an uppermost coil and one or more lower coils beneath the upper coil, wherein the straight pipe banks and return bend banks in the coils are aligned in plan. In another embodiment, the present invention provides a refinery process furnace, comprising a firebox, at least one multiple-pass, double-row, helical-horizontal radiant coil, with nested tube-side flow paths, disposed completely within the firebox except for inlet and outlet piping at ends of passes thereof, which can optionally pass through a wall of the firebox or connect to another coil within the firebox, and three rows of floor-fired burners, one disposed between the rows of the coil and the other two disposed on either side of the rows of the coil and evenly spaced therefrom in plan. The firebox is preferably elongated with opposite ends provided with removable panels for removing and replacing the coil. Straight horizontal pipe sections of the coil rows can be supported by one or more spaced-apart ladders. The ladders comprise first and second vertical columns and a plurality of elongated spacer elements attached at either end thereof to the vertical columns to maintain the columns in horizontally spaced-apart relation. Opposing support members having a generally horizontal upper engagement surface are vertically spaced along the vertical columns. Transverse crosspieces have opposite ends engaged by the support members, each end having a generally horizontal lower engagement surface supported on the upper engagement surface which allows for any horizontal, upward or angled movement of the transverse crosspiece with respect to the support members due to thermal expansion thereof, or shifting of the vertical columns with respect to each other. A cradle is formed in the crosspieces for supporting the horizontal pipe section thereon.

In a further aspect of the invention, there is provided an improvement in a refinery process furnace having a plurality of horizontal pipe sections arranged in one or more vertical banks within a firebox wherein the horizontal pipe sections thereof are supported by one or more ladders. The improvement is that the ladder or ladders comprise first and second vertical columns, and a plurality of elongated spacer elements attached at either end thereof to the vertical columns to maintain the columns in horizontally spaced-apart relation. Opposing support members are vertically spaced along the vertical columns. The support members have a generally horizontal upper engagement surface. Transverse crosspieces have opposite ends engaged by the support members, each end having a generally horizontal lower engagement surface supported on the upper engagement surface which allows for any horizontal, upward or angled movement of the transverse crosspiece with respect to the support members due to thermal expansion thereof or shifting of the vertical columns with respect to each other. A cradle is formed in the crosspieces for supporting the horizontal pipe section thereon. The vertical columns can be supported at a lower end thereof on a floor of the firebox, or from an upper end thereof on an arch of the firebox. Or, the vertical columns can have an upper section having an upper end thereof supported from an arch of the firebox, and a lower section having a lower end thereof supported from a floor of the firebox, wherein an upper end of the lower section is slideably engaged with a lower end of the upper section to provide a continuous vertical column from the floor to the arch. The vertical columns can comprise I-beams, or rectangular tubular members that can be cooled by circulating air through the tubular members, for example, the air can be circulated by drafting through the tubular members. The support members preferably comprise a horizontal projection with a vertical slot formed therein and the crosspieces a generally horizontally projecting lateral member with a fin depending therefrom, wherein the fin is loosely received in the slot to limit lateral movement of the crosspiece, and wherein end-to-end movement of the crosspiece is limited by opposing stops between which the crosspiece is loosely received. The stops can be a vertical surface of the vertical columns positioned to engage the end of the crosspiece, or an end of the slot positioned to engage an outer end of the fin. The lateral member and the fin are preferably generally continuous from one end of the crosspiece to the other.

DETAILED DESCRIPTION

Figure 1:
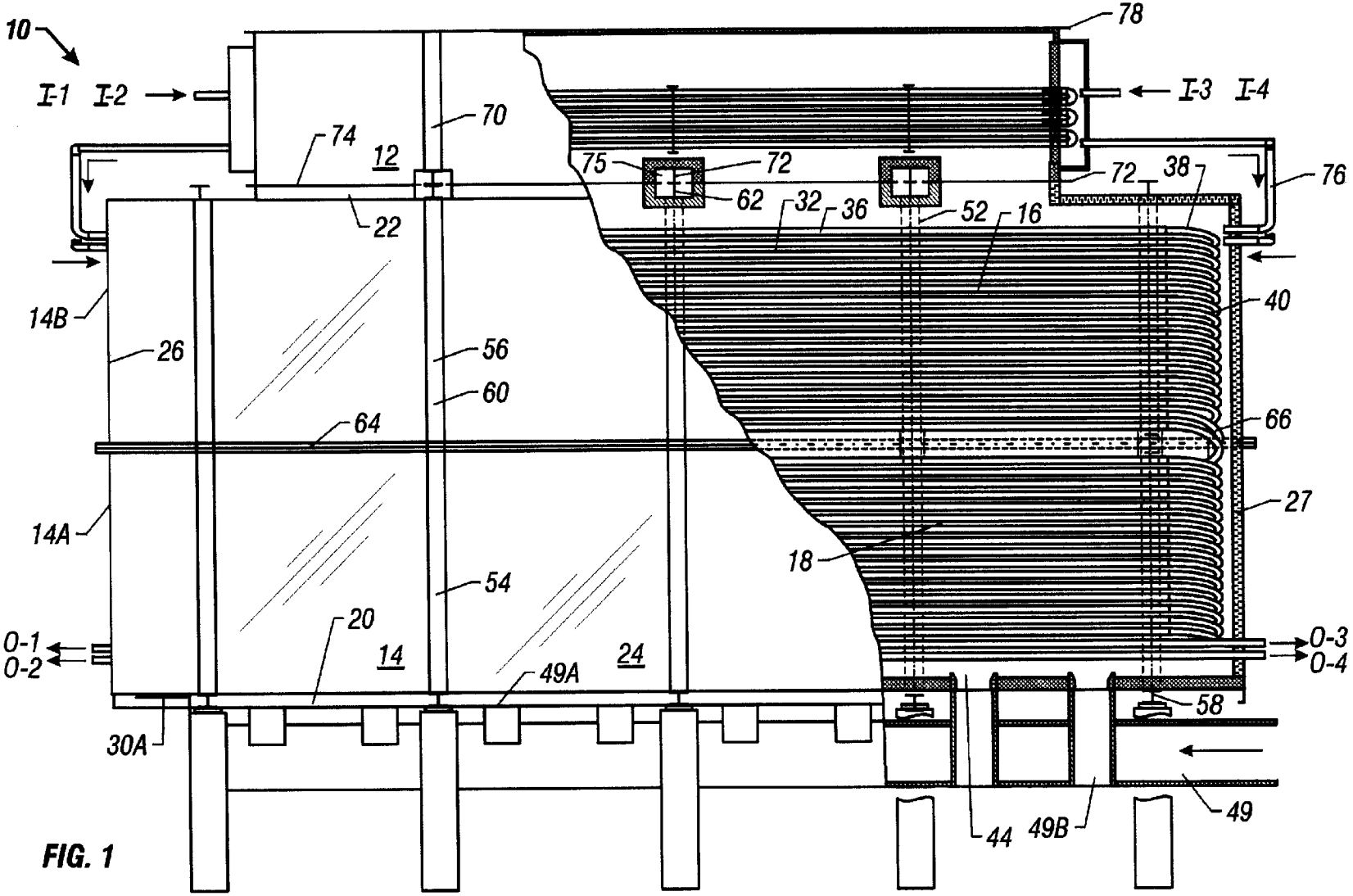
FIG. 1 is a side sectional view of a furnace in accordance with one embodiment of the invention.
Figure 2:
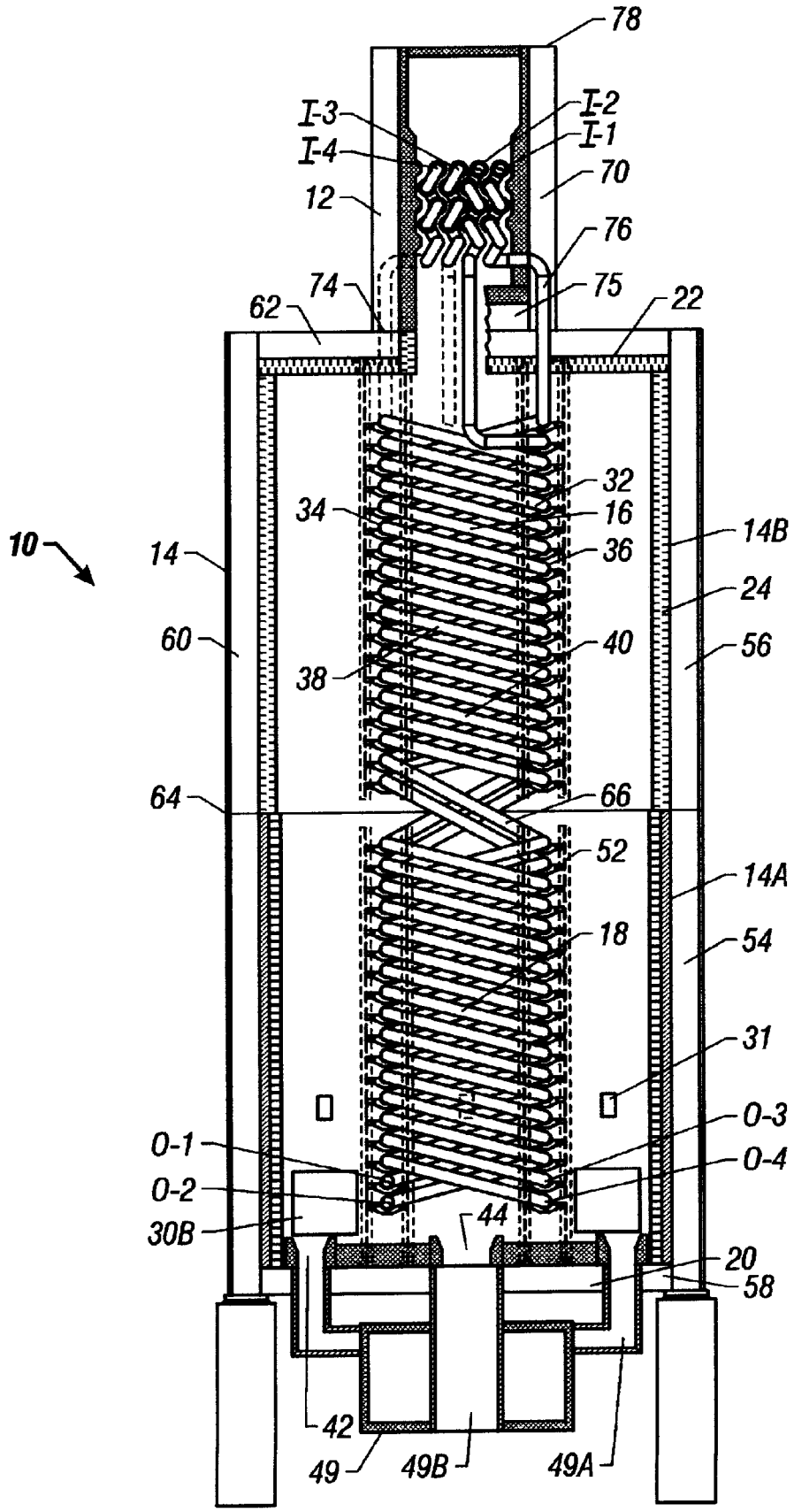
FIG. 2 is an end sectional view of the furnace of FIG. 1.
Figure 3:
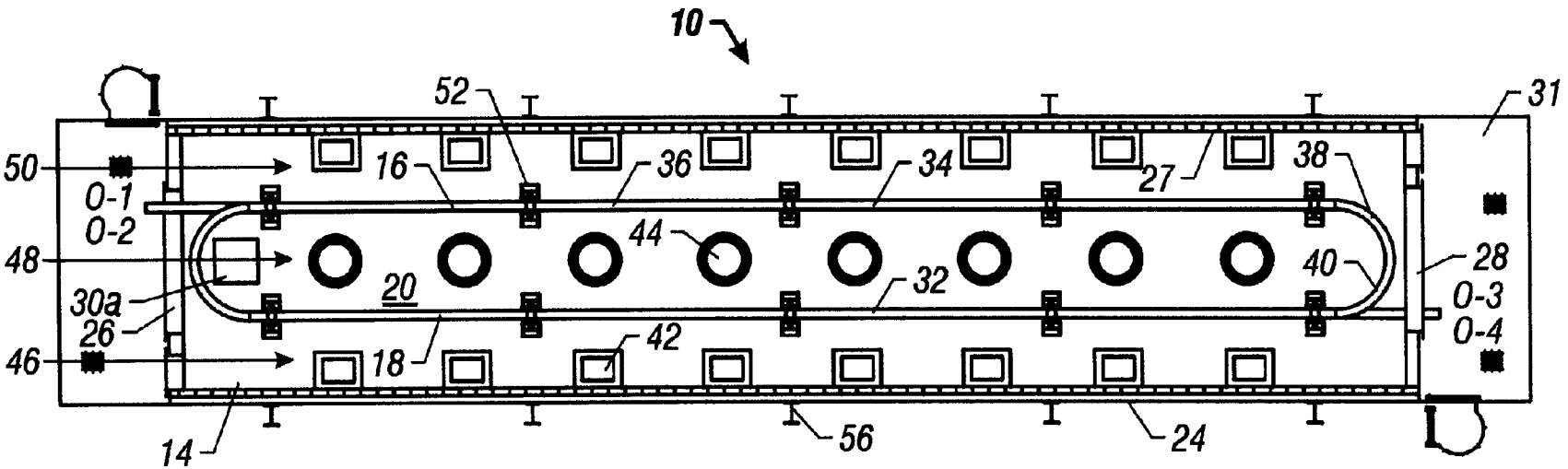
FIG. 3 is a plan view of the furnace of FIGS. 1 and 2.

With reference to FIGS. 1–3, a furnace 10 according to one embodiment of the present invention has a generally conventional convection section 12 and a radiant section or firebox 14 housing an upper radiant coil 16 and lower radiant coil 18.

The firebox 14 has floor 20, arch 22, sidewalls 24 and end walls 26, suitably lined with conventional refractory material 27. A removable panel 28 (see FIG. 3) is provided in each end wall 26 for access to the coils 16 and 18. Conventional access doors 30A and 30B may also be provided in the floor 20 or end walls 26, respectively, or elsewhere in the furnace 10. Conventional peep sights 31 are provided in the end walls 26, which can be accessed by a platform 33 (see FIG. 3), provided at either end of the furnace 10.

Each of the radiant coils 16 and 18 comprises a pair of parallel banks 32,34 of horizontal tube or pipe sections 36. The horizontal pipe sections 36 are arranged in the vertical banks 32,34, one on top of the other, evenly spaced apart in each coil 16,18. Preferably, the center-to-center vertical spacing of the horizontal pipe sections 36 in the vertical banks 32,34 from adjacent horizontal pipe sections 36 next above and/or below is about 1.5 to 2.5 times the outside diameter of the horizontal pipe sections 36. For example, for nominal 4-inch (114.3 mm O.D.) pipe, the center-to-center spacing can be about 8 inches (203 mm) or allows for even tighter packing of the tubes to reduce the vertical height of the coils 16,18, but still provides for relatively even heating around each of the pipe sections 36.

Each radiant coil 16,18 also has a bank 38 of wide sweep return bends 40. The return bends 40 have a larger radius than conventional return bends, such as "short-radius" (typically 2 times the nominal tube diameter) and "long-radius" (typically 3 times the nominal tube diameter). Preferably, the return bends 40 have a radius at least 5 times the nominal tube or pipe diameter, more preferably at least 7 times the nominal diameter, and especially at least 7.5 times the outside diameter. The radius of the return bends 40 should also be sufficient to allow the minimum horizontal-to-centerline clearance of the tube banks 32,34 to the centerline of the burners 44 per API Standard 560, Table 12, Column B, which is hereby incorporated herein by reference. It is understood that the radius of the return bends 40 is measured along the centerline of the tube or pipe. For 4 inch nominal pipe (114.3 mm O.D.) and 4 mmBtu/hr gas-fired burners 44, for example, we prefer an approximately 34-inch (864 mm) radius (a center-to-center spacing of 5 feet (1.524 m) between tube banks 32,34 and a 16-inch (406 mm) vertical drop between inlet and outlet horizontal pipe sections 36 in each pass). The length or run of each horizontal pipe section 36 is generally longer than the diameter of bends 40 so that the majority of the heat transfer is in the horizontal pipe sections 36, although some heat transfer is also obtained in the return bends 40.

As best illustrated in FIG. 3, the burners 42,44 are mounted in the floor 20 of the firebox 14 and arranged in plan in longitudinal rows 46,48 of outside burners 42 and row 50 of inside burners 44. The burners 42,44 have conventionally associated fuel supplies, controls, valves, dampers, etc. (not shown) for supplying air and fuel to each burner 42,44. A preheated air supply duct 49 is shown in FIGS. 1 and 2, along with air supply ducts 49A,49B supplying air to the burners 42,44, respectively.

The burners 42,44 in each row 46,48,50 are evenly spaced horizontally apart from each other and laterally from and/or between the vertical banks 32,34 of horizontal pipe sections 36 so as to evenly introduce heat into the firebox 14 and avoid flame impingement on the coils 16,18. In general, the return bends 40 are spaced further from the burners 42,44 on the ends of each of the rows 46,48,50 than the horizontal pipe sections 36 are. The outside burners 42 are generally placed adjacent sidewalls 24 and produce a flat or planar flame generally parallel to the adjacent sidewall 24. The inside burners 44 produce either a round or flat flame. Typically the inside burners 44 preferably produce about 1.5 times as much heat as the outside burners 42.

Where the coils 16,18 comprise more than two vertical tube banks 32,34, additional inside burners 44 are similarly situated in additional rows (not shown) evenly spaced between the additional vertical tube banks (not shown).

Each of the horizontal pipe sections 36 in the vertical banks 32,34 is supported at regular intervals by a plurality of ladders 52 as best illustrated in FIGS. 1–3. The ladders 52 can be supported with upper ends supported from the arch 22, as illustrated with respect to upper coil 16, or with lower ends mounted on the floor 20, as illustrated with respect to lower coil 18. The ladders 52 are preferably spaced between the burners 42,44 to minimize the temperatures to which they are exposed.

The return bends 40 can be made by bending tubing or pipe and cutting at 180 degree intervals. The coils 16,18 are then fabricated by welding the return bends 40 to the horizontal pipe sections 36 supported on the ladders 52. The ladders 52 can be supported from the firebox 14 housing before or after assembly of the coils 16,18. The furnace 10 is desirably fabricated, transported and assembled in a modularized configuration, providing each of the lower firebox section 14A, upper firebox section 14B and convection section 12 as modular units. The lower firebox section 14A comprises a bottom half of the rectangular housing of the firebox 14, the lower coil 18 and the lower section of each ladder 52, pre-assembled with refractory lining 27 on the inside, and lower sections 54 of vertical support columns 56 and floor support members 58 secured on the outside. The lower firebox section 14A is shipped to the installation site and placed with support columns 56 on concrete pilings 59. Outlets O-1,O-2,O-3,O-4 are welded or flanged to connecting piping (not shown).

The upper firebox section 14B comprises a top half of the rectangular housing of the firebox 14, the upper coil 16 and the upper section of each ladder 52, likewise pre-assembled with refractory lining 27 on the inside, and upper sections 60 of vertical support columns 56 and top support members 62 secured on the outside. The upper firebox section 14B is placed on top of lower firebox section 14A and perimeter flanges 64 are bolted together to connect the sections 14A, 14B. The lower outlet tubing from the upper coil 16 is field-welded to the upper inlet tubing to the lower coil 18 at either end of the relatively longer wide sweep return bends 66.

The convection section 12 is likewise shipped pre-assembled with refractory lining 27, exterior vertical support members 70 and horizontal lower support members 72. The convection section 12 can be attached to the firebox 14 by securing the perimeter flanges 74 between the upper firebox section 14B and the convection section 12. The horizontal support members 72 of the convection section 12 are aligned with the top support members 62 of the upper firebox section 14B, and can also be bolted together. The support members 62,72 pass through transverse passages 75 at the bottom of the convection section 12 and line up with the ladders 52 and the vertical support members 56 for strength reinforcement. The furnace 10 thus has a flat head arch configuration with flue gas passages from the firebox 14 between the transverse passages 75 and the end walls of the convection section 12.

The inlets I-1,I-2,I-3,I-4 to the convection section 12 are welded or flanged to connecting piping (not shown). The crossover piping 76 between the convection section 12 and the inlet piping into the upper coil 16 is connected outside the furnace 10. Other conventional arch configurations are also suitably employed with the coil design of the present invention.

The breach on the top of the convection section 12 is secured thereto, for example, by bolting at the top perimeter flange 78. The breaching (not shown) is conventional and can be a breaching tapered to a stack and/or ducted through an air preheater exchanger (not shown).

Figure 4:
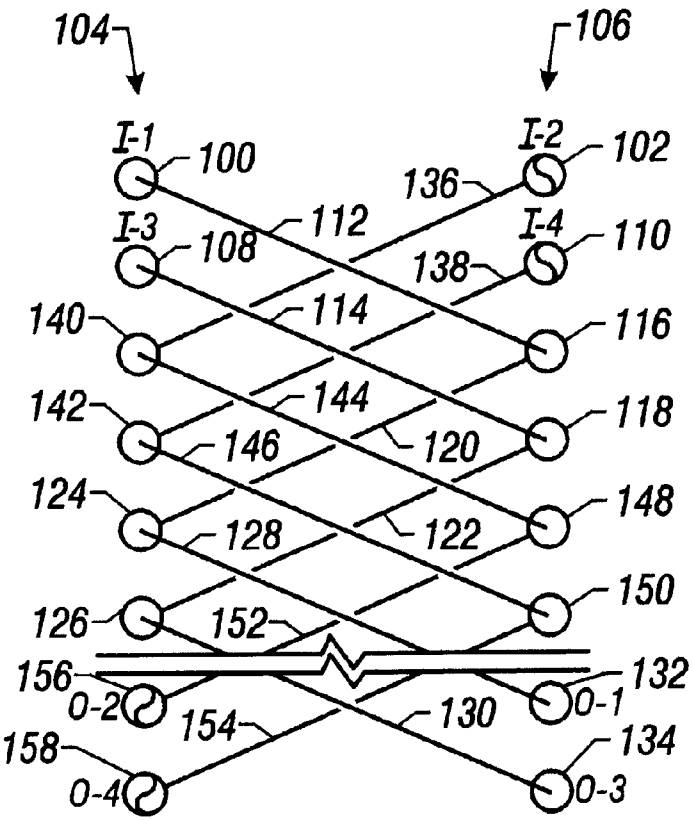
FIG. 4 is a schematic drawing showing the flow paths of the four-pass radiant coil in the furnace of FIGS. 1–3.

The embodiment illustrated in FIGS. 1–3 shows nested four-pass radiant coils 16,18, which produce a helical-horizontal flow pattern. As shown schematically in FIG. 4, in the four-pass embodiment, the inlets I-1, I-2 for the respective first and second passes feed into the topmost tubes 100,102 on the respective left and right tube banks 104,106. The inlets I-3,I-4 for the respective third and fourth passes feed into the second highest tubes 108,110 just beneath the uppermost tubes 100,102, respectively. The inlets I-1,I-3 are at the far end of the tube bank 104, whereas the inlets I-2,I-4 are at the near end of the tube bank 106, establishing opposite horizontal flow directions. At the near end of the tube bank 104, wide sweep return bends 112,114 pass fluid from the end of tubes 100,108 into third and fourth sequential tubes 116,118 in tube bank 106, respectively. The first and third pass fluids then pass through far-end wide sweep return bends 120,122, fifth and sixth tubes 124,126 in left tube bank 104, near-end wide sweep return bends 128,130, and finally in penultimate and lowermost tubes 132,134 to the far-end outlets O-1,O-3 in right tube bank 106, respectively. Similarly, second and fourth pass fluids pass from the far ends of tubes 102,110 in right tube bank 106, through far-end wide sweep return bends 136,138, third and fourth highest tubes 140,142 in left tube bank 104, near-end wide sweep return bends 144,146, fifth and sixth highest tubes 148,150 in right tube bank 106, far-end wide sweep return bends 152,154, and continue this helical-horizontal flow pattern finally through penultimate and lowermost tubes 156,158 to the near-end outlets O-2,O-4.

Figure 5:
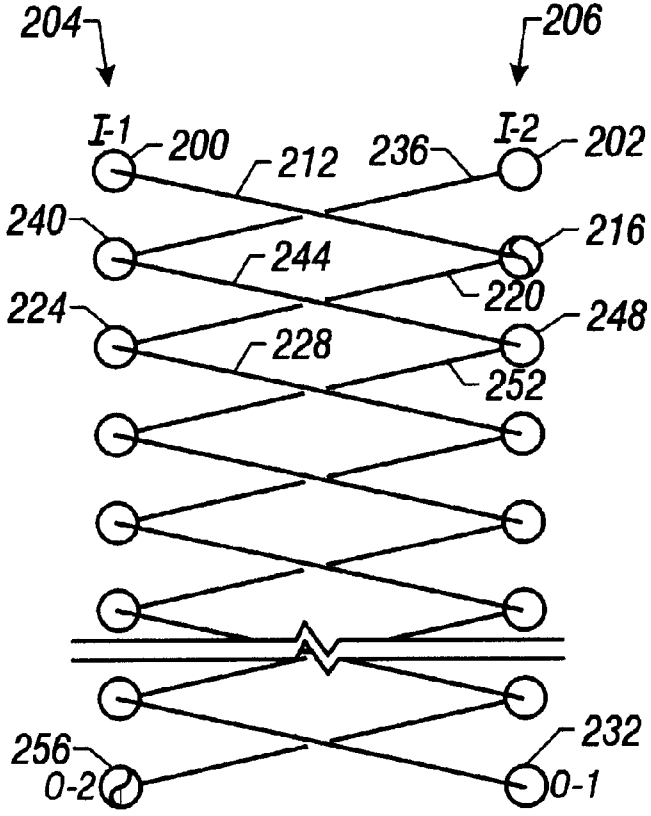
FIG. 5 is a schematic drawing showing the flow paths of a two-pass radiant coil in accordance with an alternate embodiment of the invention.

As shown schematically in FIG. 5, in the two-pass embodiment, the inlets I-1, I-2 for the respective first and second passes feed into the topmost tubes 200,202 on the respective left and right tube banks 204,206. The inlet I-1 is at the far end of the tube bank 204, whereas the inlet I-2 is at the near end of the tube bank 206, establishing opposite horizontal flow directions. At the near end of the tube bank 204, wide sweep return bend 212 passes fluid from the end of tube 200 into second sequential tube 216 in tube bank 206. The first pass fluid then passes through far-end wide sweep return bend 220, third tube 224 in left tube bank 204, near-end wide sweep return bend 228, continues this helical-horizontal flow pattern finally into lowermost tube 232 to the far-end outlet O-1 in right tube bank 206. Similarly, second pass fluid passes from the far end of tube 202 in right tube bank 206, through far-end wide sweep return bend 236, second highest tube 240 in left tube bank 204, near-end wide sweep return bend 244, third highest tube 248 in right tube bank 206, far-end wide sweep return bend 252, and continues this helical-horizontal flow pattern finally through lowermost tube 256 to the near-end outlet O-2.

Figure 6:
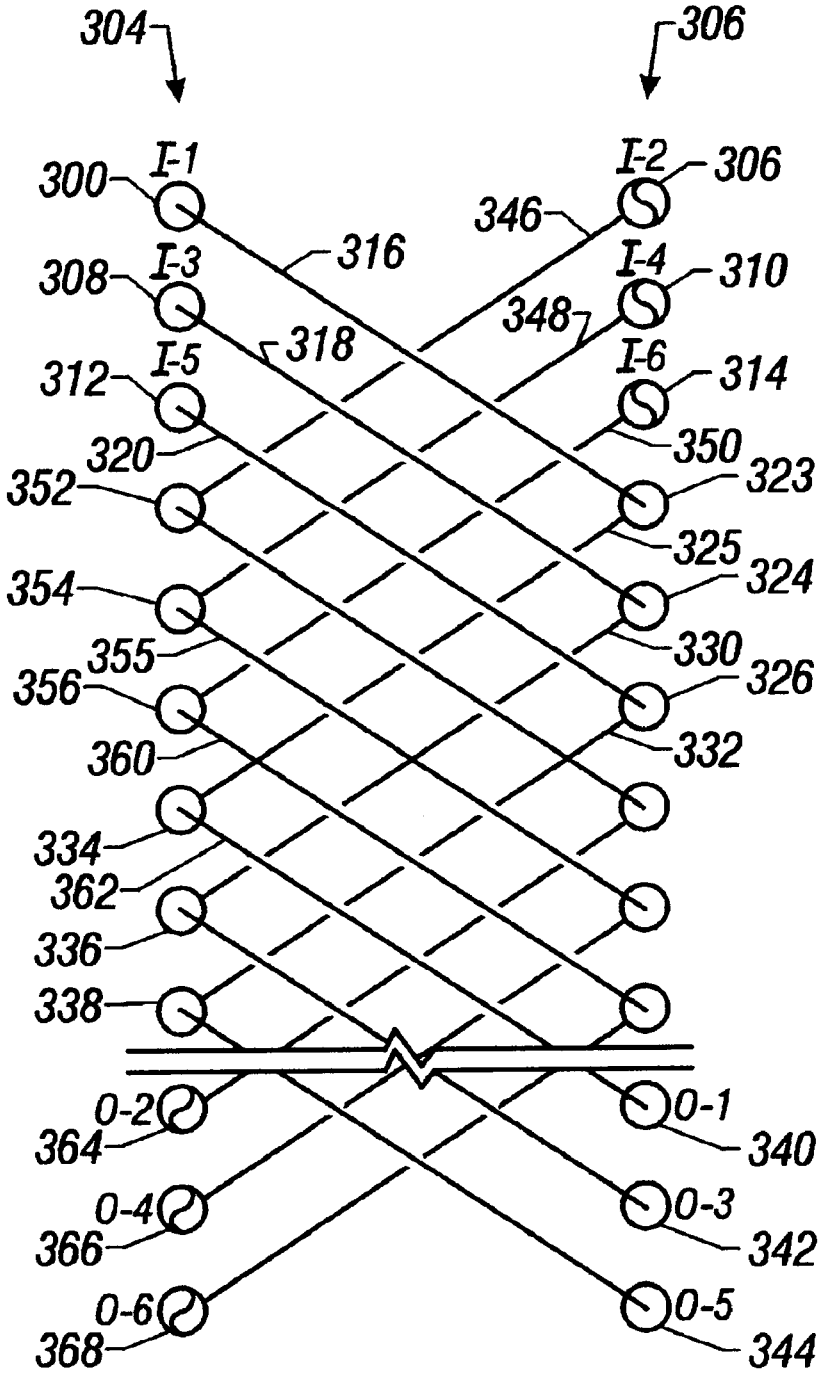
FIG. 6 is a schematic drawing showing the flow paths of a six-pass radiant coil in accordance with an alternate embodiment of the invention.
Figure 7:
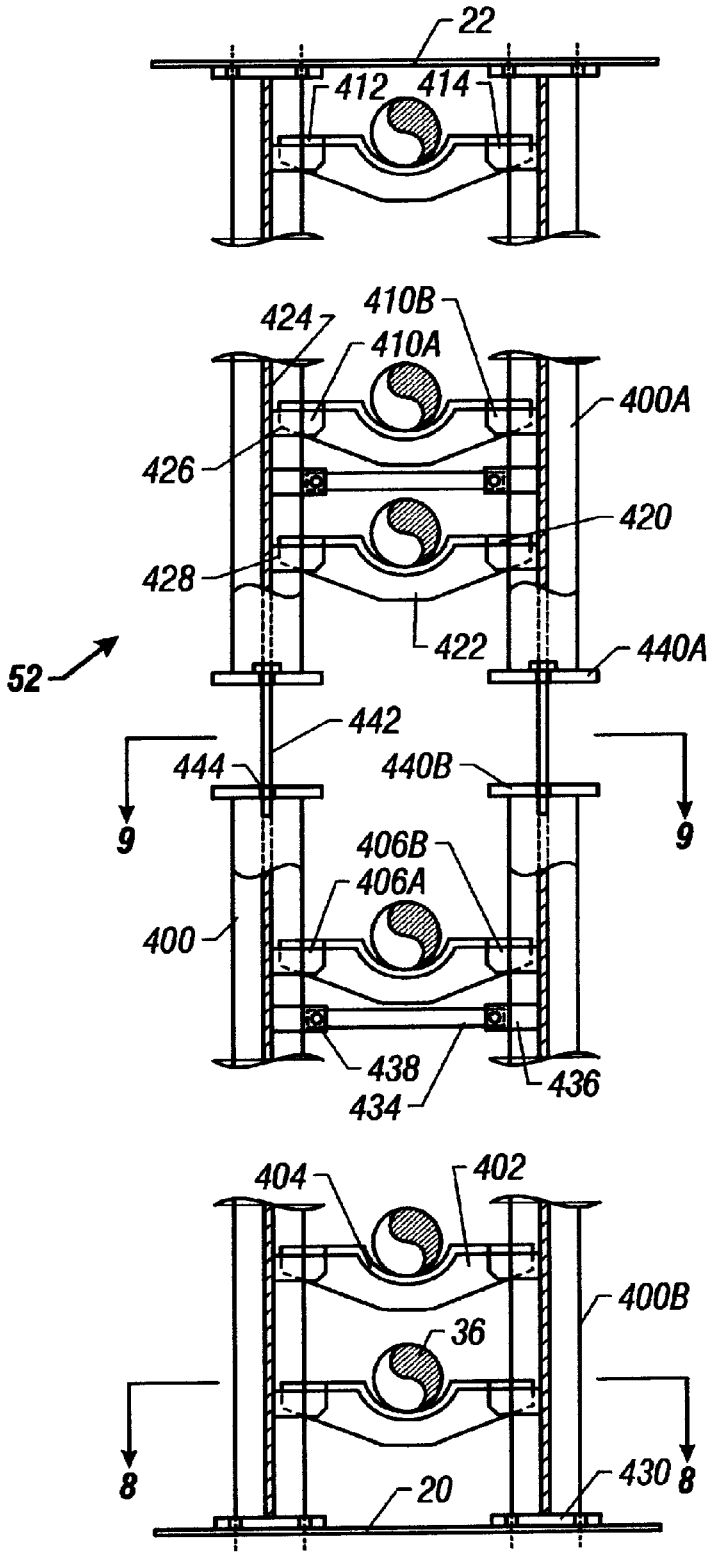
FIG. 7 is a side elevation view of a ladder for supporting pipe sections in the furnace of FIGS. 1–3 according to an embodiment of the invention.
Figure 8:
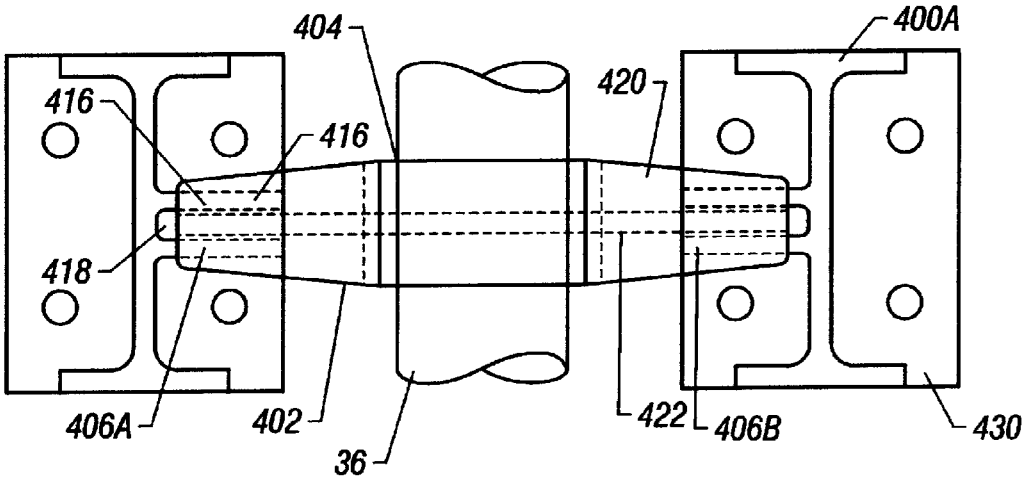
FIG. 8 is a sectional view of the ladder of FIG. 7 as seen along the lines 8—8.
Figure 9:
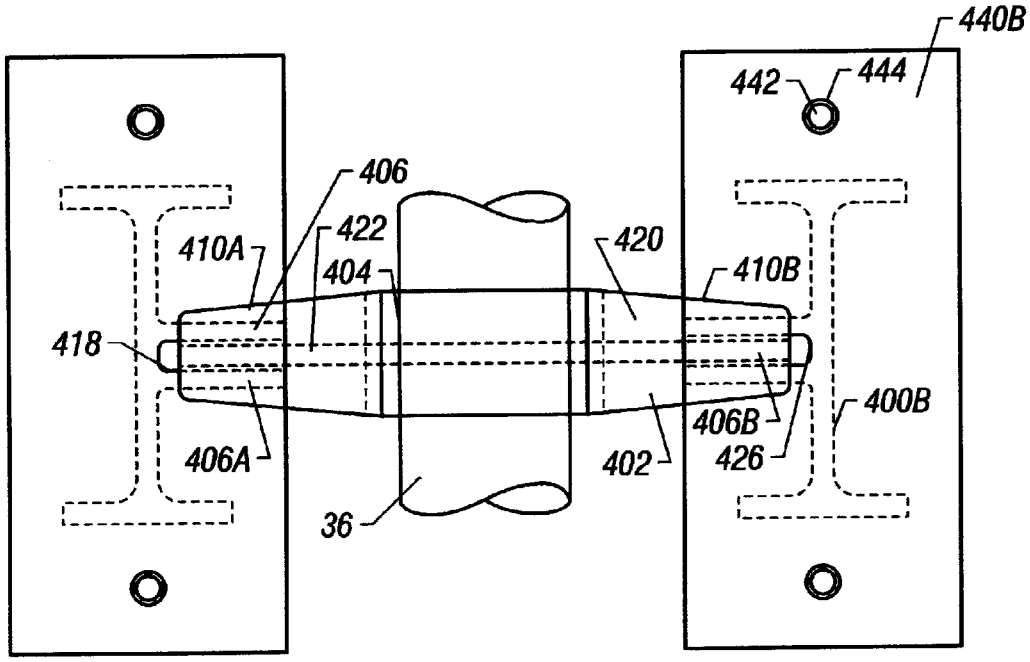
FIG. 9 is a sectional view of the ladder of FIG. 7 as seen along the lines 9—9.
Figure 10:
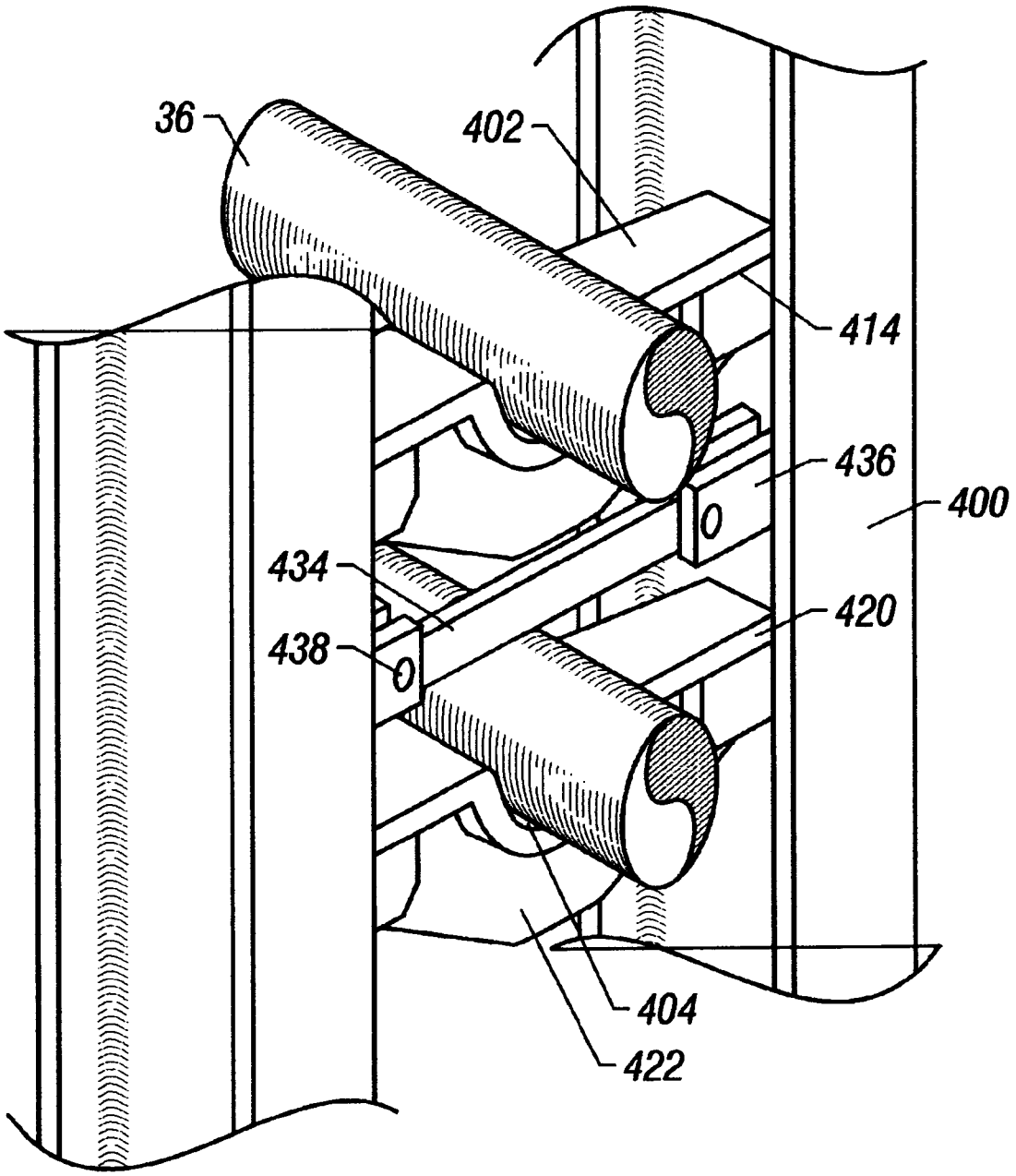
FIG. 10 is an isometric view of the ladder of FIGS. 7–9.
Figure 11:
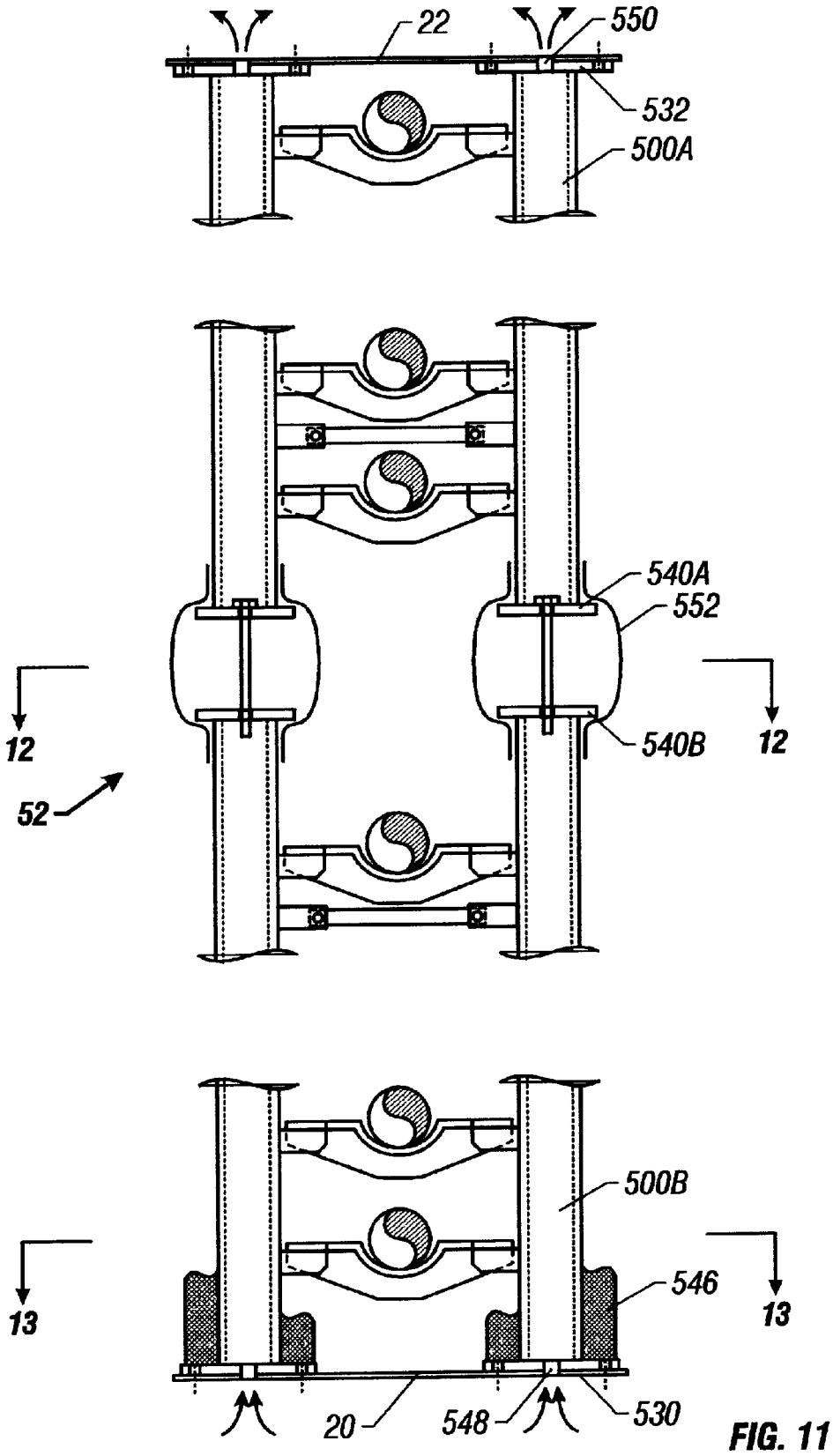
FIG. 11 is a side elevation view of a ladder for supporting pipe sections in a furnace according to an alternate embodiment of the invention.
Figure 12:
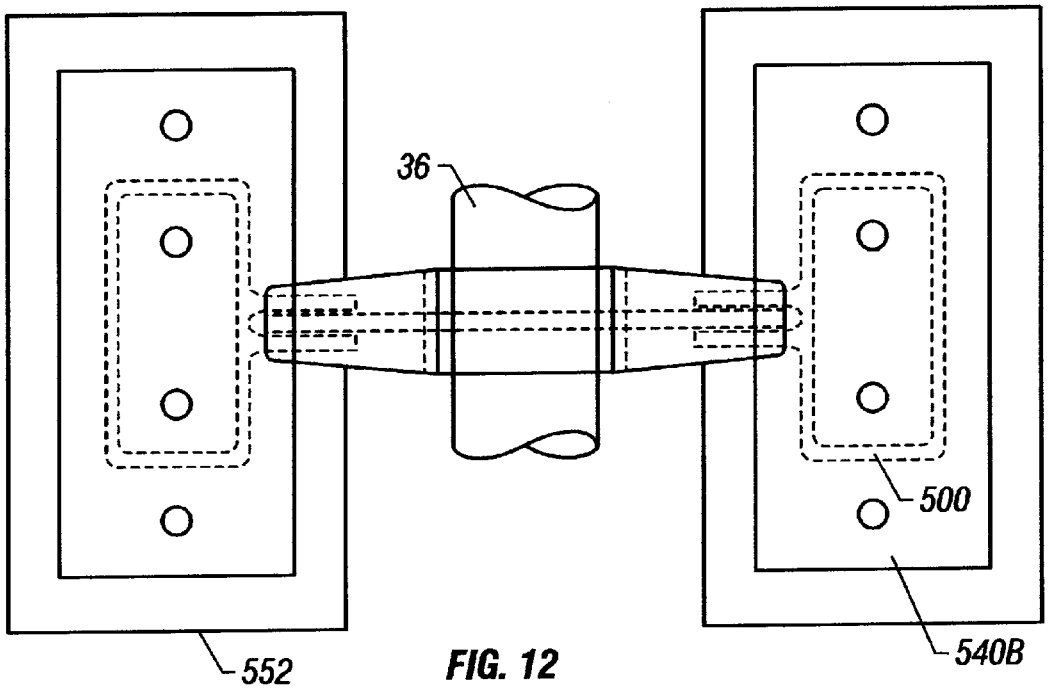
FIG. 12 is a sectional view of the ladder of FIG. 11 as seen along the lines 12—12.
Figure 13:
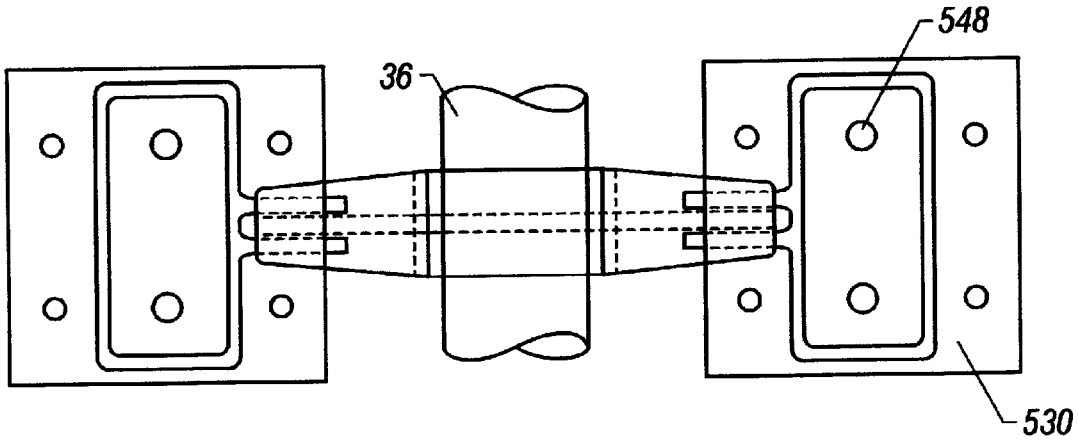
FIG. 13 is a sectional view of the ladder of FIG. 11 as seen along the lines 13—13.
Figure 14:
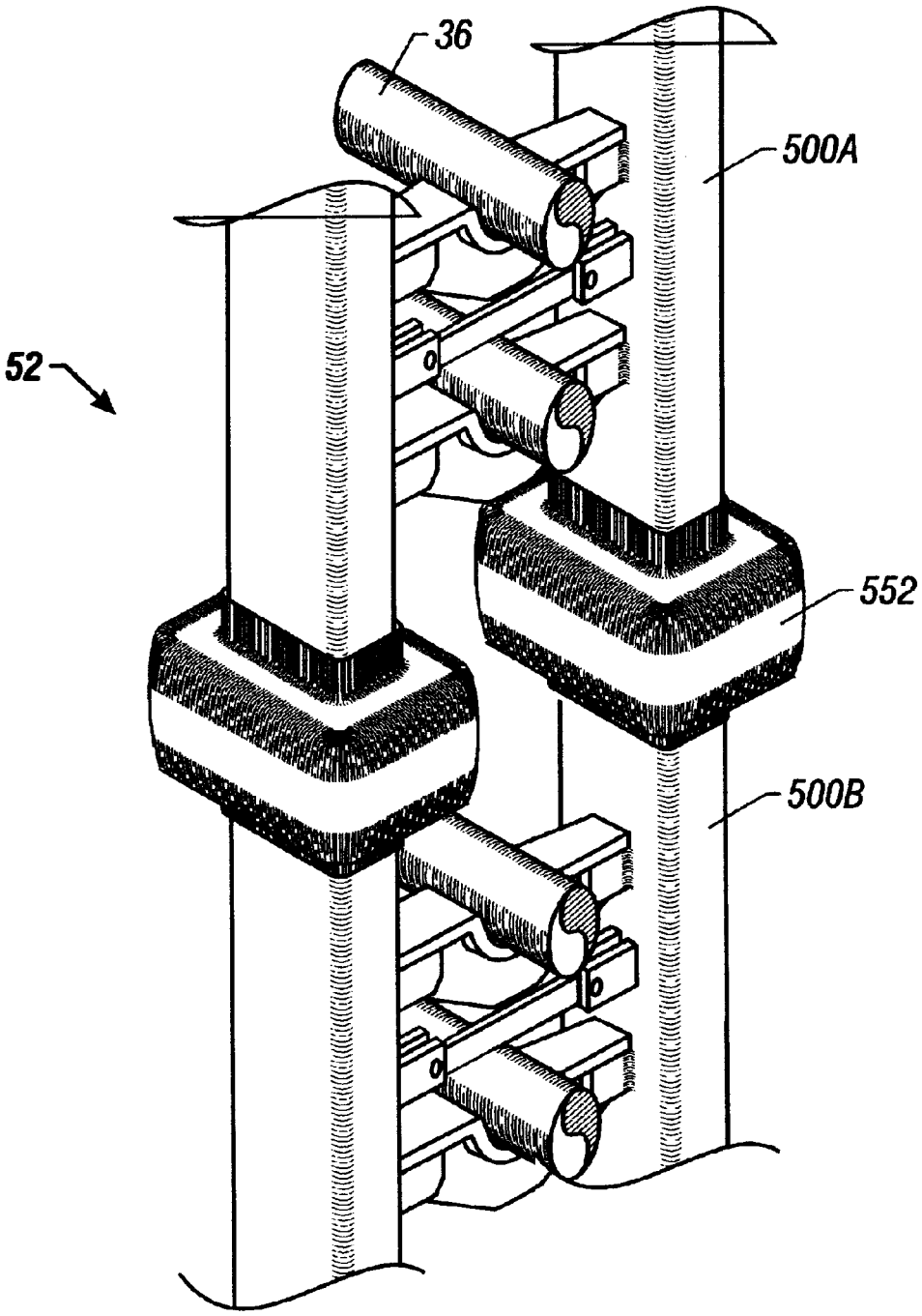
FIG. 14 is an isometric view of the ladder of FIGS. 11–13.

As shown schematically in FIG. 6, in the six-pass embodiment, the inlets I-1, I-2 for the respective first and second passes feed into the topmost tubes 300,302 on the respective left and right tube banks 304,306. The inlets I-3,I-4 for the respective third and fourth passes feed into the second highest tubes 308,310 just beneath the uppermost tubes 300,302, respectively. The inlets I-5,I-6 for the respective fifth and sixth passes feed into the third highest tubes 312,314 just beneath the second highest tubes 308,310, respectively. The inlets I-1,I-3,I-5 are at the far end of the tube bank 304, whereas the inlets I-2,I-4,I-6 are at the near end of the tube bank 306, establishing opposite horizontal flow directions. At the near end of the tube bank 304, wide sweep return bends 316,318,320 pass fluid from the end of tubes 300,308,312 into fourth, fifth and sixth sequential tubes 322,324,326 in tube bank 306, respectively. The first, third and fifth pass fluids then pass through far-end wide sweep return bends 328,330,332, seventh, eighth and ninth tubes 334,336,338 in left tube bank 304, and continue in this helical-horizontal flow pattern finally into third-to-last, penultimate and lowermost tubes 340,342,344 to the far-end outlets O-1,O-3,O-5 in right tube bank 306, respectively. Similarly, second, fourth and sixth pass fluids pass from the far ends of tubes 302,310,314 in right tube bank 306, through far-end wide sweep return bends 346,348,350, fourth, fifth and sixth sequential tubes 352,354,356 in left tube bank 304, near-end wide sweep return bends 358,360, 362, and continue this helical-horizontal flow pattern finally through third-to-last, penultimate and lowermost tubes 364, 366,368 to the near-end outlets O-2,O-4,O-6 which form the outlet pipe section for left tube bank 304.

FIGS. 7–10 show the details of one embodiment of the assembly of ladders 52. Each ladder 52 has a pair of vertical support columns 400 that are laterally spaced apart, and a plurality of transverse crosspieces 402 that span the support columns 400 and have a saddle 404 for supporting the horizontal pipe sections 36. A crosspiece 402 is generally provided for each pipe section 36 to be supported. The crosspieces 402 are evenly spaced vertically to maintain each pipe section 36 in the appropriate vertical spacing. Opposing support members 406A,406B are mounted on each column 400 at the same height and have a generally horizontal upper engagement surface 412. The transverse crosspieces 402 have opposite ends 410A,410B supported on the upper engagement surface 412 of the members 406A,406B, each end 410A,410B having a generally horizontal lower engagement surface 414 supported on the upper engagement surface 412. This allows for any horizontal, upward or angled movement of the transverse crosspiece 402 with respect to the support members 406A,406B due to thermal expansion of the crosspieces 402, or lateral, front-to-back and/or vertical shifting of the vertical support columns 400 with respect to each other.

The support members 406A,406B preferably have a horizontal projection 416 with a vertical slot 418 (see FIG. 8) formed therein. The crosspieces 402 preferably have a generally horizontally projecting lateral member 420 with a fin 422 depending therefrom. The fin 422 is loosely received in the slot 418 to limit lateral movement of the crosspiece 402. End-to-end movement of the crosspiece 402 is limited by opposing stops between which the crosspiece 402 is loosely received. For example, each stop can include a vertical surface 424 of the vertical columns 400 positioned to engage the end of the crosspiece 402, an end 426 of the slot 418 positioned to engage an outer end 428 of the fin 422, or a combination of these. The lateral member 420 and the fin 422 are preferably generally continuous from one end of the crosspiece 402 to the other to strengthen the crosspiece 402 and provide an upper surface for supporting the horizontal pipe section 36. The crosspieces 402 can be made from an alloy by casting into the desired shape.

The support columns 400 are made from a generally vertical steel alloy I-beam and have a lower base 430 bolted to the floor 20 of the furnace 10. A similar base 432 at the upper end bolts to the arch 22 of the furnace 10. A plurality of elongated cross-ties 434 are attached at either end thereof to mounts 436 projecting from each vertical column 400 to maintain the columns 400 in horizontally spaced-apart relation. The cross-ties 434 are placed between every fourth or fifth crosspiece 402, for example, or can be used more or less frequently as they are needed or desired. The cross-ties 434 are secured by a relatively loose pin-and-slot connection 438 that allows for limited relative movement of the cross-ties 434 with respect to the columns 400 as might be experienced by thermal expansion.

Where upper and lower coils 16,18 are used, for example, separate upper and lower columns 400A and 400B can similarly be used to facilitate the modularity of the furnace 10, as discussed above. The upper column 400A is supported from the arch 22 by bolting at the base 432, while the lower column 400B is mounted on the floor 20 by bolting at the base 430, as mentioned above. The lower end of the upper column 400A is slideably interengaged with the upper end of the lower column 400B to allow for relative differential upward and downward movement of the columns due to thermal expansion. This is effected, for example, by means of respective end plates 440A and 440B, which are wider than the cross-section of columns 400, and a plurality guide pins 442, which are received through guide holes 444 formed in either or both of the end plates 440A,440B and laterally spaced from the footprint of the columns 400.

With reference to FIGS. 11–14, there is shown an alternate embodiment of the ladders 52 which are similar in design and construction as the ladders 52 shown in the embodiment of FIGS. 7–10, except that the vertical columns 500A,500B have a generally tubular construction to allow a cooling fluid such as air to be circulated therethrough. This allows the columns 500A,500B to be kept at a relatively lower temperature with the potential for extending the useful life thereof. The support columns 500A,500B can be provided with a layer of insulation 546, if desired, for additional thermal protection of the columns 500A,500B. Relatively cool air can be drafted into the lower end of the column 500B by providing one or more apertures 548, which extend through the base plate 530 and the floor 20 of the furnace 10. Air which is heated and rises through the columns 500A, 500B is vented at the top of the column 500A through similar apertures 550 formed through base plate 532 and the arch 22 of the furnace 10. Expandable flexible boots 552 extending from above the end plate 540A at the upper end of the lower column 500A to below the end plate 540B at the lower end of the upper column 500B provide a passage for drafting air from the top of column 500B into the bottom of column 500A. If desired, the air can also be forced or induced, either continuously or intermittently, through the columns 500A,500B by fans (not shown) if sufficient air Flow is not achieved by drafting.

Figure 16:
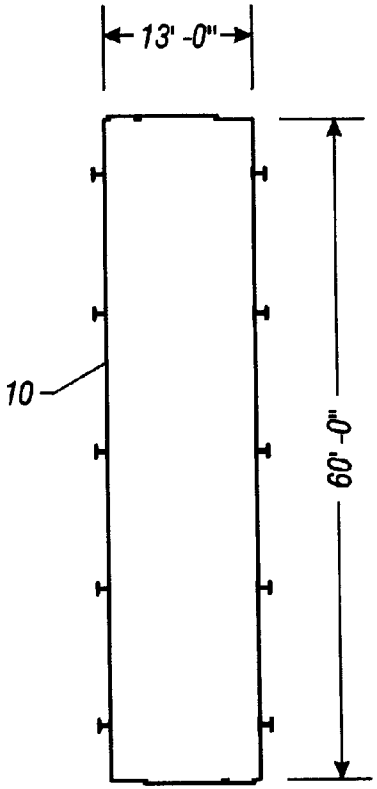
FIG. 16 is a plot plan of a single-cell, four-pass furnace according to the principles of the present invention having the same heating capacity and throughput as the four-cell furnace of FIG. 15 showing a considerably smaller footprint.
Figure 15:
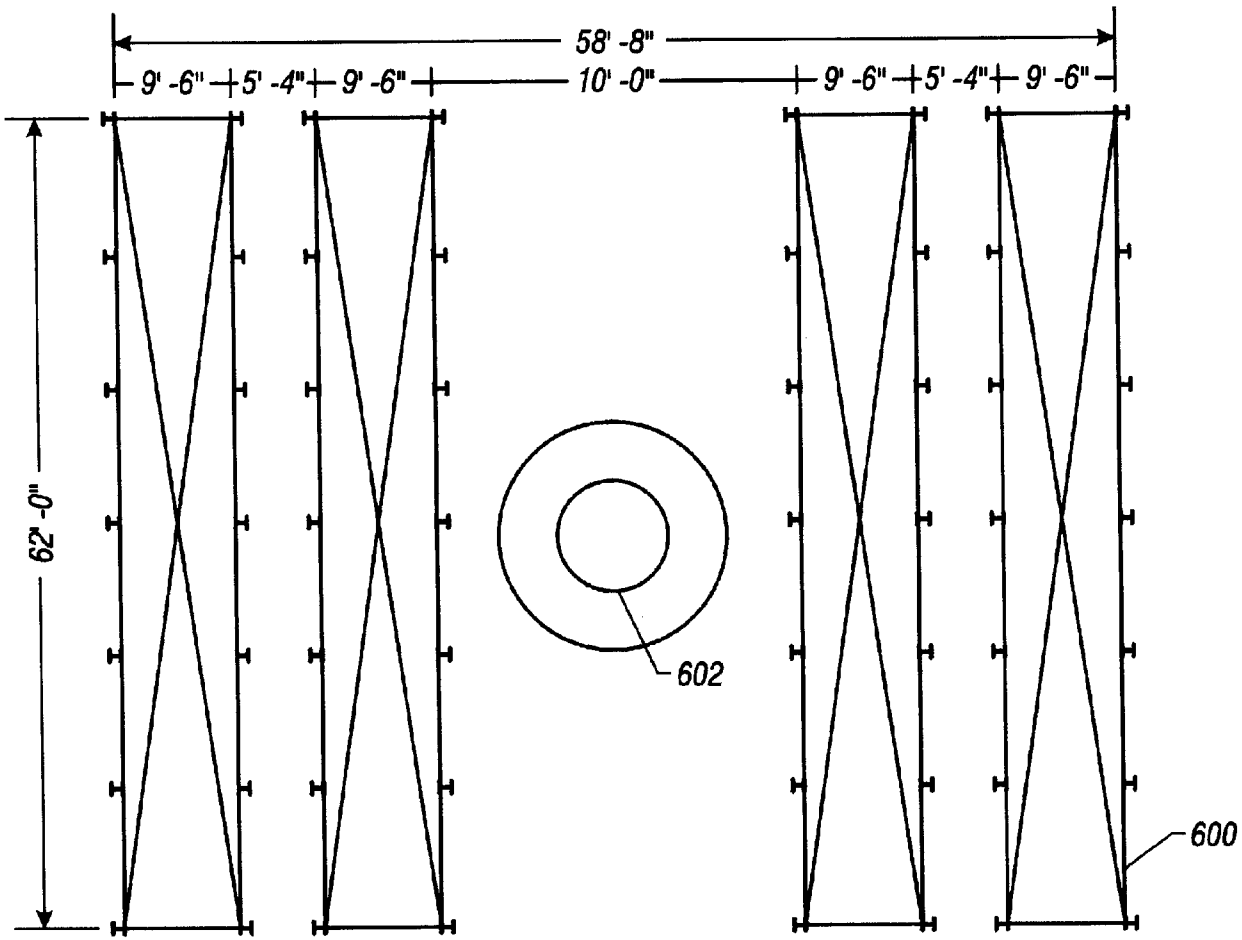
FIG. 15 (Prior Art)
FIG. 15 (prior art) is a plot plan of a conventional four-cell furnace with one pass per cell and an associated stack showing a relatively large footprint.

The horizontal helical coils of the present invention can be used in multiple sets arranged vertically or side-by-side within the furnace to obtain more passes within a single firebox. This greatly increases the amount of heat transfer that can be obtained with a given plot size or footprint. For example, the particular four-box 600 furnace with a central stack 602 using the design of U.S. Pat. No. 5,078,857 to Melton has the 62'0" by 58'8" (18.9 m by 17.9 m) footprint as illustrated in FIG. 15, and uses 80 burners. By using the present design, a furnace with the same design capacity as that of FIG. 15 has a single firebox with a footprint measuring just 13'0" by 60'0" (4 m by 18.3 m) as shown in FIG. 16, and only 36 burners are required, three rows of twelve each. The reduction in the number of burners similarly reduces the number of dampers, air and fuel supply lines, valves and controls, and simplifies the operation of the furnace.

The horizontal-helical coil arrangement with the internally disposed wide sweep return bends provides increased effective tube surface area because some heat transfer is effected in the wide sweep return bends. In contrast, the return bends of the prior art furnaces are typically placed outside the firebox so no heat transfer occurs (other than cooling if the bends are not adequately insulated). Also, the wide sweep return bends present less tube-side pressure drop than the short- or long-radius returns used in the prior art. Since the wide sweep return bends of the present furnace design are, unlike the prior art return bends used in delayed coker heaters, placed within the furnace firebox, as mentioned, they also eliminate the conventional insulated end tube supports, closure plates and/or header boxes. Access to the wide sweep return bends in the present invention is instead provided through removable end wall panels. The end wall panels can also accommodate complete coil removal with the tube supports.

In the present design, multiple burner rows are arranged alternately with the horizontal tube rows. This results in a more uniform heating arrangement so that hot and cold spots on the tube walls are minimized. This arrangement has the flexibility to be expanded to include multiple sets of radiant coils disposed side-by-side within the same firebox, further reducing the number of burners required and the amount of firebox wall which is needed per length of tubing.

In the present design, the radiant coil support is provided using multiple intermediate ladder-type supports. This offers design flexibility for either bottom-supported or top-hung configurations. The multi-piece ladder design also allows the use of high alloy cast materials that have better long-term durability in furnace conditions. The ladder design facilitates both the initial furnace assembly as well as periodic long-term maintenance.

EXAMPLE

A design of the furnace according to the present invention shown in FIG. 16 is compared to the prior art Melton design of FIG. 15. The two furnaces are each designed for delayed coker preheat service for processing 27,500 BPD of feedstock with a radiant section heating duty of 76.7 MMBtu/hr. The FIG. 15 prior art furnace design requires four fireboxes with one pass each, with burners located on either side of the tube bank, whereas the present design of FIG. 16 can use just one firebox with four nested passes. The design characteristics are presented in Table 1 below:

TABLE 1

Furnace Radiant Section Design Comparison

| Feature/Characteristic | Melton Design | Present Design |
|---|---|---|
| Capacity (BPD) | 27,500 | 27,500 |
| Tube OD (inches) | 4.5 | 4.5 |
| Tube ID (inches) | 3.791 | 3.791 |
| Tube vertical spacing, center-to-center (inches) | 8.0 | 8.0 |
| Straight tube length (feet) | | |
| Heated length | 61 | 53 (56@inlet&outlet) |
| Total length | 63 | 53 |
| Bend length (feet) | | |
| Heat transfer surface | 0.0 | 8.13 |
| Equiv., pressure drop | 11.1 | 12.0 |

TABLE 1-continued

Furnace Radiant Section Design Comparison

| Feature/Characteristic | Melton Design | Present Design |
|---|---|---|
| Number of total passes | 4 | 4 |
| Number of tubes, total | 72 | 72 |
| Number of cells | 4 | 1 |
| Tube banks per cell | 1 | 2 |
| Tube bank height (feet) | 12 | 24 |

It is seen from the data in Table 1 that the four fireboxes used to heat the coker feedstock in the prior art design of FIG. 15 can be replaced with just one firebox in the present design of FIG. 16. While the same number of tubes are used, the present design uses shorter straight pipe sections because heat transfer is also obtained in the return bends which are located within the firebox, whereas the prior art short radius return bends are located outside the fireboxes. While the tubing costs for the two designs are about the same, the firebox cost is about half that of the prior art design. The flow characteristics, pressure drop and pump power and costs are presented in Table 2:

TABLE 2

Furnace Radiant Design Comparison-Fluid Flow

| Feature/Characteristic | Melton Design | Present Design |
|---|---|---|
| Pressure drop (psi) | 158 | 140 |
| Equivalent length of tubing (feet) | 1320 | 1164 |
| Pump head (feet) | 208.4 | 189.7 |
| Pump power (hp) | 198 | 180 |
| Annual pump cost (85% efficiency, U.S. $0.03/kwh) | $61,200 | $55,700 |

It is seen from the data in Table 2 that the pressure drop and pumping cost of the present furnace design are lower than the prior art design, primarily because there is reduced pressure drop through the sweep return bends in the present design relative to the radius returns of the prior art delayed coker charge heaters. The heat transfer and burner layout are presented in Table 3:

TABLE 3

Furnace Radiant Design Comparison - Heat Transfer

| Feature/Characteristic | Melton Design | Present Design |
|---|---|---|
| Total/surface area ($ft^2$) | 5174 | 5175 |
| Average flux ($Btu/ft^{2-}h$) | 14,828 | 14,826 |
| Peak flux ($Btu/ft^{2-}h$) | 17,794 | 17,791 |
| Number of burners | 80 | 36 |
| Burners per row | 10 | 12 |
| Burner rows per cell | 2 | 3 |
| Burner duty (MMBtu/h) | | |
| Side/wall burners | 1.79 | 3.5 |
| Middle burners | N/A | 5.0 |

From the data in Table 3, it is seen that the present furnace design is greatly simplified because only 36 burners are used, compared to the 80 of the comparable prior art Melton furnace, while at the same time average and peak heat flux are about the same. Considering that an air damper and a fuel valve must be used for each burner, along with associated piping and controls, this greatly simplifies the furnace.

While the coil, furnace and tube support design are described above with reference to delayed coking unit charge heaters, it is understood that the designs are like wise applicable to visbreakers, crude heaters, hot oil heaters, vacuum unit heaters and other refinery process furnaces.

What is claimed is:

1. A radiant coil for a refinery process furnace, comprising:

an inlet pipe section;

an outlet pipe section;

a plurality of essentially straight horizontal pipe sections arranged in at least two vertical banks, wherein the vertical banks are parallel and horizontally spaced apart a sufficient distance to facilitate placement of evenly spaced rows of burners between the vertical banks;

a plurality of bent pipe sweep return bends arranged in vertical banks at either end of the straight pipe banks, each bend connecting a pair of straight pipe sections in adjacent vertical banks thereof, wherein the return bends are sloped between horizontal and vertical and one of the straight pipe sections in the connected pair thereof is elevated with respect to the other; and a tubeside fluid flow path from the inlet pipe section through an alternating series of the straight pipe sections and the return bends to the outlet pipe section.

2. The coil of claim 1 comprising first and second vertical straight pipe banks and opposing return bend banks, wherein the straight pipe sections and the return bends are evenly spaced from adjacent sections and bends above and below except for uppermost and lowermost pipe sections and return bends.

3. The coil of claim 2 wherein the return bends at either end of the adjacent tube banks are oppositely sloped so as to provide a generally horizontal-helical flow pattern.

4. A radiant coil for a refinery process furnace, comprising:

an inlet pipe section:

an outlet pipe section;

a plurality of essentially straight horizontal pipe sections arranged in at least two vertical banks, wherein the vertical banks are parallel and horizontally spaced apart;

a plurality of bent pipe sweep return bends arranged in vertical banks at either end of the straight pipe banks, each bend connecting a pair of straight pipe sections in adjacent vertical banks thereof, wherein the return bends are sloped between horizontal and vertical and one of the straight pipe sections in the connected pair thereof is elevated with respect to the other, wherein the return bends at either end of the adjacent tube banks are oppositely sloped so as to provide a generally horizontal-helical flow pattern;

a tubeside fluid flow path from the inlet pipe section through an alternating series of the straight pipe sections and the return bends to the outlet pipe section;

first and second vertical straight pipe banks and opposing return bend banks, wherein the straight pipe sections and the return bends are evenly spaced from adjacent sections and bends above and below except for uppermost and lowermost pipe sections and return bends;

first and second nested passes wherein the fluid flow paths of the first and second passes each comprise a series of alternating straight pipe sections in each of said vertical banks thereof wherein the straight pipe sections of the first pass in the first and second banks are horizontally spaced opposite the straight pipe sections of the second pass in the respective second and first banks.

5. The coil of claim 4 wherein the first and second pass straight pipe sections in each vertical tube bank are alternated every other one from top to bottom.

6. The coil of claim 4 further comprising nested third and fourth passes wherein the fluid flow paths of the third and fourth passes each comprise a series of alternating straight pipe sections in each of said vertical banks thereof wherein the straight pipe sections of the third pass in the first and second banks are horizontally spaced opposite the straight pipe sections of the fourth pass in the respective second and first banks.

7. The coil of claim 6 wherein the first, second, third and fourth pass straight pipe sections in each vertical tube bank are alternated every fourth one from top to bottom.

8. The coil of claim 6 further comprising nested fifth and sixth passes wherein the fluid flow paths of the fifth and sixth passes each comprise a series of alternating straight pipe sections in each of said vertical banks thereof wherein the straight pipe sections of the fifth pass in the first and second banks are horizontally spaced opposite the straight pipe sections of the sixth pass in the respective second and first banks.

9. The coil of claim 8 wherein the first, second, third, fourth, fifth and sixth pass straight pipe sections in each vertical tube bank are alternated every sixth one from top to bottom.

10. A refinery process furnace, comprising:

a firebox having a floor, opposing vertical sidewalls, and opposing vertical end walls;

the coil of any one of claims 1, 3, 5, 7 or 9 disposed with the straight pipe banks and the return bend banks within the firebox wherein endmost vertical straight pipe banks are evenly spaced from and generally parallel to the vertical side walls, each of the return bend banks are evenly spaced from the end walls, and the inlet and outlet sections are disposed for introducing a relatively cold fluid into the flow paths and discharging a heated fluid therefrom, respectively;

multiple rows of floor mounted burners arranged alternately and evenly spaced in plan with respect to the vertical straight pipe banks.

11. The refinery process furnace of claim 10 comprising a plurality of said coils arranged in a vertical stack with an uppermost coil and one or more lower coils beneath the upper coil, wherein the straight pipe banks and return bend banks in the said plurality of coils are aligned in plan.

12. A refinery process furnace, comprising:

a firebox;

at least one multiple-pass, double-row, helical-horizontal radiant coil, with nested tube-side flow paths, disposed completely within the firebox except for inlet and outlet piping at ends of passes thereof which can optionally pass through a wall of the firebox or connect to another coil within the firebox;

three rows of floor-fired burners, one disposed between the rows of the coil and the other two disposed on either side of the rows of the coil and evenly spaced therefrom in plan.

13. The refinery process furnace of claim 12 wherein the firebox is elongated with opposite ends provided with removable panels for removing and replacing the coil.

14. The refinery process furnace of claim 12 wherein straight horizontal pipe sections of the coil rows are supported by one or more spaced-apart ladders, wherein the ladder or ladders comprise:

first and second vertical columns;

a plurality of elongated spacer elements attached at either end thereof to the vertical columns to maintain the columns in horizontally spaced-apart relation;

opposing support members vertically spaced along the vertical columns, wherein the support members have a generally horizontal upper engagement surface;

transverse crosspieces having opposite ends engaged by the support members, each end having a generally horizontal lower engagement surface supported on the upper engagement surface allowing for any horizontal, upward or angled movement of the transverse crosspiece with respect to the support members due to thermal expansion thereof or shifting of the vertical columns with respect to each other;

a cradle formed in the crosspieces for supporting the horizontal pipe section thereon.

15. The furnace of claim 14 wherein the vertical columns are supported at a lower end thereof from a floor of the firebox.

16. The furnace of claim 14 wherein the vertical columns are supported from an upper end thereof on an arch of the firebox.

17. The furnace of claim 14 wherein the vertical columns have an upper section having an upper end thereof supported from an arch of the firebox, and a lower section having a lower end thereof supported from a floor of the firebox, wherein an upper end of the lower section is slideably engaged with a lower end of the upper section to provide a continuous vertical column from the floor to the arch.

18. The furnace of claim 14 wherein the vertical columns comprise I-beams.

19. The furnace of claim 14 wherein the vertical columns comprise rectangular tubular members.

20. The furnace of claim 19 wherein the columns are cooled by circulating air through the tubular members.

21. The furnace of claim 20 wherein the air is circulated by drafting through the tubular members.

22. The furnace of claim 14 wherein the support members comprise a horizontal projection with a vertical slot formed therein and the crosspieces comprise a generally horizontally projecting lateral member with a fin depending therefrom, wherein the fin is loosely received in the slot to limit lateral movement of the crosspiece, and wherein end-to-end movement of the crosspiece is limited by opposing stops between which the crosspiece is loosely received.

23. The furnace of claim 22 wherein the stops comprise a vertical surface of the vertical columns positioned to engage the end of the crosspiece.

24. The furnace of claim 22 wherein the stops comprise an end of the slot positioned to engage an outer end of the fin.

25. The furnace of claim 22 wherein the lateral member and the fin are generally continuous from one end of the crosspiece to the other.

* * * * *